US009941081B1

(12) United States Patent
Chou

(10) Patent No.: US 9,941,081 B1
(45) Date of Patent: Apr. 10, 2018

(54) SENSOR SWITCH AND METHOD OF ASSEMBLY THEREOF

(71) Applicant: Tien-Ming Chou, Taichung (TW)

(72) Inventor: Tien-Ming Chou, Taichung (TW)

( * ) Notice: Subject to any disclaimer, the term of this patent is extended or adjusted under 35 U.S.C. 154(b) by 0 days.

(21) Appl. No.: 15/376,712

(22) Filed: Dec. 13, 2016

(30) Foreign Application Priority Data

Oct. 6, 2016 (TW) ..... 105132318

(51) Int. Cl.
*H01H 35/02* (2006.01)
*H01H 1/16* (2006.01)
*H01H 11/06* (2006.01)

(52) U.S. Cl.
CPC ..... *H01H 35/02* (2013.01); *H01H 1/16* (2013.01); *H01H 11/06* (2013.01); *H01H 2011/062* (2013.01)

(58) Field of Classification Search
CPC ..... H01H 35/02; H01H 1/16; H01H 11/06; H01H 2011/062; H01H 35/025; H01H 1/58; H01H 35/144; H01H 35/14; H01H 2001/0005
USPC ..... 200/61.45 R, 61.45 M, 61.52, 277, 1 R, 200/61.11, 84 R, 220, 193, 229, 52 R, 200/215
See application file for complete search history.

(56) References Cited

U.S. PATENT DOCUMENTS 5,136,127 A * 8/1992 Blair ..... H01H 35/02 200/61.45 R
5,672,856 A * 9/1997 Kolb ..... H01H 35/02 200/61.45 R
7,326,867 B2 * 2/2008 Kelley, Jr. ..... G01C 9/06 200/61.45 M
7,421,793 B2 * 9/2008 Kelley, Jr. ..... G01C 9/06 200/61.45 M

FOREIGN PATENT DOCUMENTS

JP 2003161653 A 6/2003

* cited by examiner

*Primary Examiner* — Edwin A. Leon
(74) *Attorney, Agent, or Firm* — Trop Pruner & Hu, P.C.

(57) ABSTRACT

A sensor switch includes an insulated housing having an inner wall surface that defines a through hole. The through hole has a shoulder interconnecting large and small diameter hole sections thereof. A first conductive terminal includes a head portion embedded in the large diameter hole section and having a first contact surface. A plug portion of a second conductive terminal is embedded in the large diameter hole section spaced apart from the head portion and has a second contact surface facing the first contact surface. The inner wall surface and the first and second contact surfaces cooperatively confine a sensing chamber. At least one conductive member is rollably accommodated in the sensing chamber.

15 Claims, 14 Drawing Sheets

SENSOR SWITCH AND METHOD OF ASSEMBLY THEREOF

CROSS REFERENCE TO RELATED APPLICATION

This application claims priority of Taiwanese Patent Application Number 105132318, filed on Oct. 6, 2016.

FIELD

The disclosure relates to a sensor switch, and more particularly to a sensor switch that can achieve stability through embedding engagement among its components and a method of assembly thereof.

BACKGROUND

A sensor switch is a switch that uses a conductive member in an interior thereof to sense vibration so as to open or close a circuit. Because of its sensitivity and ability to detect vibration in all directions, the sensor switch has a very wide range of applications, and is an indispensable electronic component of many electronic products.

Currently, the conductive member of the sensor switch is confined in a cavity defined by a non-conductive shell and two electrodes. The connection between the non-conductive shell and the electrodes is strengthened through an embedding engagement.

One instance of such an embedding engagement is disclosed in FIG. 1 of Japanese Publication No. 2003-161653, wherein two electrode parts (A1, A2) are inserted into a cylindrical body (B) in two opposite mounting directions (10A, 10B), and a cylindrical enlarged head portion 3 of each electrode part (A1, A2) is engaged between annular projections 7, 8, 9 of the cylindrical body (B). However, in order to permit easy assembly of the electrode parts (A1, A2) with the cylindrical body (B), the ratio of the height of each of the annular projections 7, 8, 9 to the diameter of the cylindrical enlarged head portion 3 is too small, so that the electrode parts (A1, A2) cannot be firmly connected to the cylindrical body (B).

Another instance of the embedding engagement is disclosed in U.S. Pat. No. 7,421,793 B2. In this disclosure, two end caps are frictionally fitted into a central member. However, the distal portion of each of the end caps must have a certain length, and the interference fit of the distal portions of the end caps with the central member must be considered at the same time to produce a suitable friction force. As such, not only is the complexity of the manufacturing process of the components increased, the cost associated therewith is also increased. Further, because the connection of the end caps with the central member may be too tight, air pressure generated during assembly thereof may push the end caps outward, so that the end caps may be unstably connected to the central member, even to the point of loosening therefrom.

SUMMARY

Therefore, an object of the present disclosure is to provide a sensor switch that can alleviate at least one of the drawbacks of the prior arts and a method of assembly thereof.

According to one aspect of this disclosure, a sensor switch comprises an insulated housing, a first conductive terminal, a second conductive terminal and at least one conductive member. The insulated housing defines an axis and has an inner wall surface that defines a through hole extending from one end to the other end of the inner wall surface along the axis. The through hole has a large diameter hole section proximate to the one end of the inner wall surface, a small diameter hole section proximate to the other end of the inner wall surface and having a hole diameter smaller than that of the large diameter hole section, and a shoulder interconnecting the large and small diameter hole sections. The ratio of cross-sectional areas between the large and small diameter hole sections is larger than one (1) but smaller than three (3).

The first conductive terminal is inserted into the through hole and includes a head portion embedded in the large diameter hole section, and a stem portion embedded in the small diameter hole section. The head portion has an abutment surface abutting against the shoulder, and a first contact surface opposite to the abutment surface. The stem portion has a width measured in a direction transverse to the axis smaller than that of the head portion and has a section extending out of the small diameter hole section. The second conductive terminal is inserted into the through hole and includes a plug portion that is embedded in the large diameter hole section spaced apart from the head portion of the first conductive terminal and that has a second contact surface facing the first contact surface. The inner wall surface of the insulated housing and the first and second contact surfaces cooperatively confine a sensing chamber. The at least one conductive member is accommodated in the sensing chamber and is rollable between a closed circuit position, in which the at least one conductive member and the first and second contact surfaces cooperatively form a current path, and an open circuit position, in which the at least one conductive member and the first and second contact surfaces does not form a current path.

According to another aspect of this disclosure, a method of assembly of a sensor switch is disclosed. The sensor switch includes an insulated housing, a first conductive terminal, a second conductive terminal, and at least one conductive member. The insulated housing defines an axis and has first and second end faces opposite to each other along the axis, and an inner wall surface defining a through hole that extends from the first end face to the second end face. The through hole has a large diameter hole section proximate to the second end face, a small diameter hole section proximate to the first end face and having a hole diameter smaller than that of the large diameter hole section, and a shoulder interconnecting the large and small diameter hole sections. The first conductive terminal includes a head portion, and a stem portion having a width measured in a direction transverse to the axis smaller than that of the head portion. The head portion has an abutment surface, and a first contact surface opposite to the abutment surface. The stem portion has a stem peripheral surface, and at least one annular barb formed on the stem peripheral surface. The second conductive terminal includes a plug portion, and an end cap connected to the plug portion. The plug portion has a second contact surface, a plug peripheral surface connected to the second contact surface, and at least one annular barb formed on the plug peripheral surface. The end cap has a cap stop surface and a cap end face opposite to the cap stop surface. An assembly direction is defined as a direction parallel to the axis and extends from the second end face toward the first end face. The method of assembly includes the steps of: (A) inserting the first conductive terminal into the large diameter hole section along the assembly direction with the stem portion thereof being inserted first into the large diameter hole section; (B) pushing the first conductive terminal until the abutment surface abuts against the shoulder, during this time, the stem portion is embedded in the small diameter hole section, and a portion of the inner wall surface of the insulated housing that defines the small diameter hole portion is deformed by the at least one annular barb of the stem portion to form at least one annular groove, at least one annular barb of the stem portion and the at least one annular groove being engaged to each other, the direction of the at least one annular barb of the stem portion being opposite to the assembly direction so as to prevent the first conductive terminal from loosening from the insulated housing; (C) inserting the conductive member into the large diameter hole section along the assembly direction; and (D) inserting the plug portion of the second conductive terminal into the large diameter hole section along the assembly direction, and pushing the cap end face until the cap stop surface abuts against the second end face of the insulated housing, during this time, another portion of the inner wall surface of the insulated housing that defines the large diameter hole portion is deformed by the at least one annular barb of the plug portion to form at least another one annular groove, the at least one annular barb of the plug portion and the at least another one annular groove being engaged to each other, the direction of the at least one annular barb of the plug portion being opposite to the assembly direction so as to prevent the second conductive terminal from loosening from the insulated housing, wherein the inner wall surface and the first and second contact surfaces cooperatively define a sensing chamber, and the at least one conductive member is rollably accommodated in the sensing chamber.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
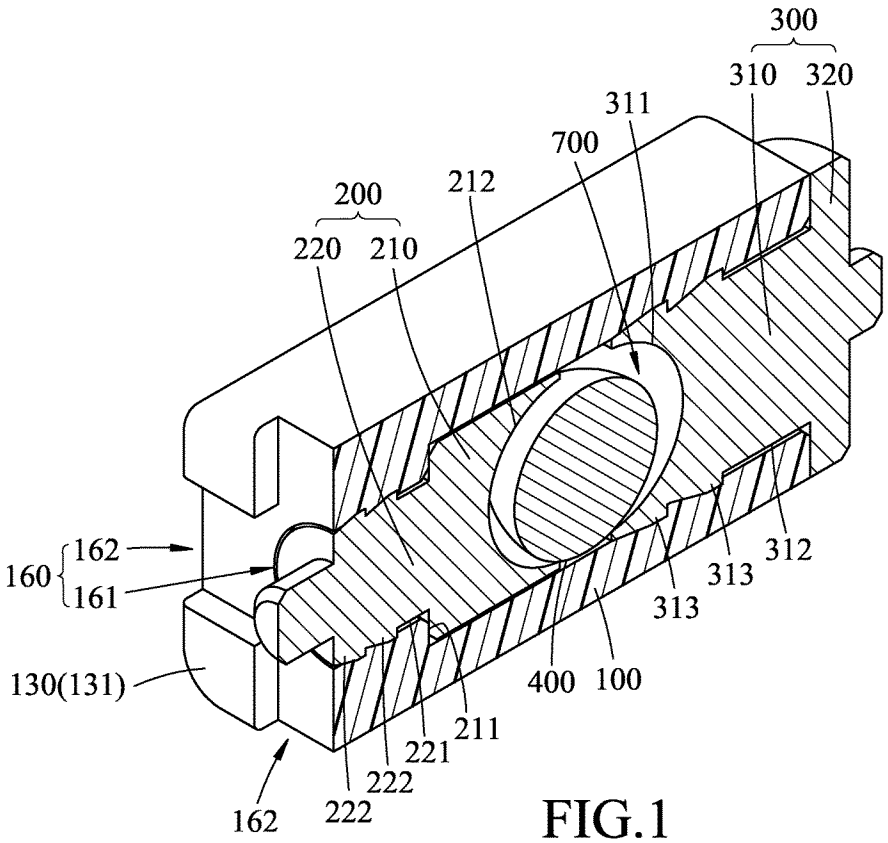
FIG. 1 is a sectional perspective view of a sensor switch according to the first embodiment of the present disclosure.

Before the pre sent disclosure is described in greater detail with reference to the accompanying embodiments, it should be noted herein that like elements are denoted by the same reference numerals throughout the disclosure.

Figure 2:
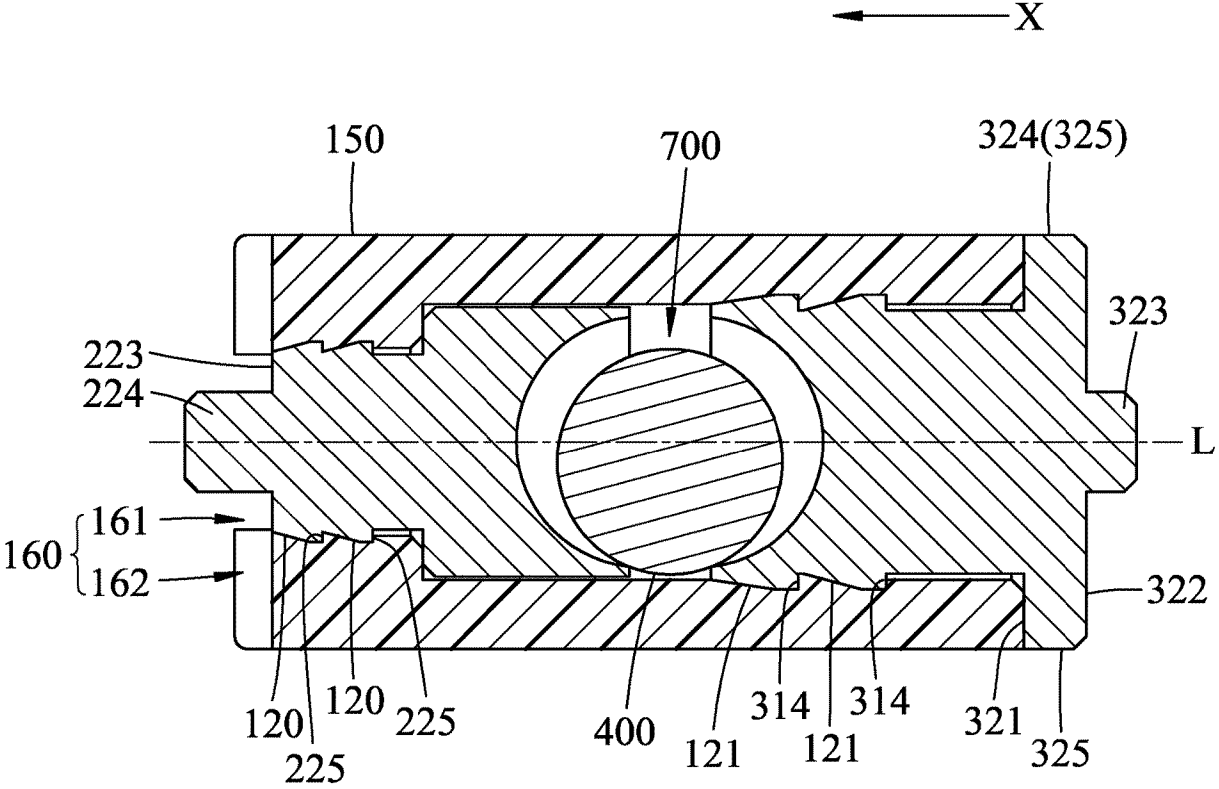
FIG. 2 is a front sectional view of FIG. 1.
Figure 3:
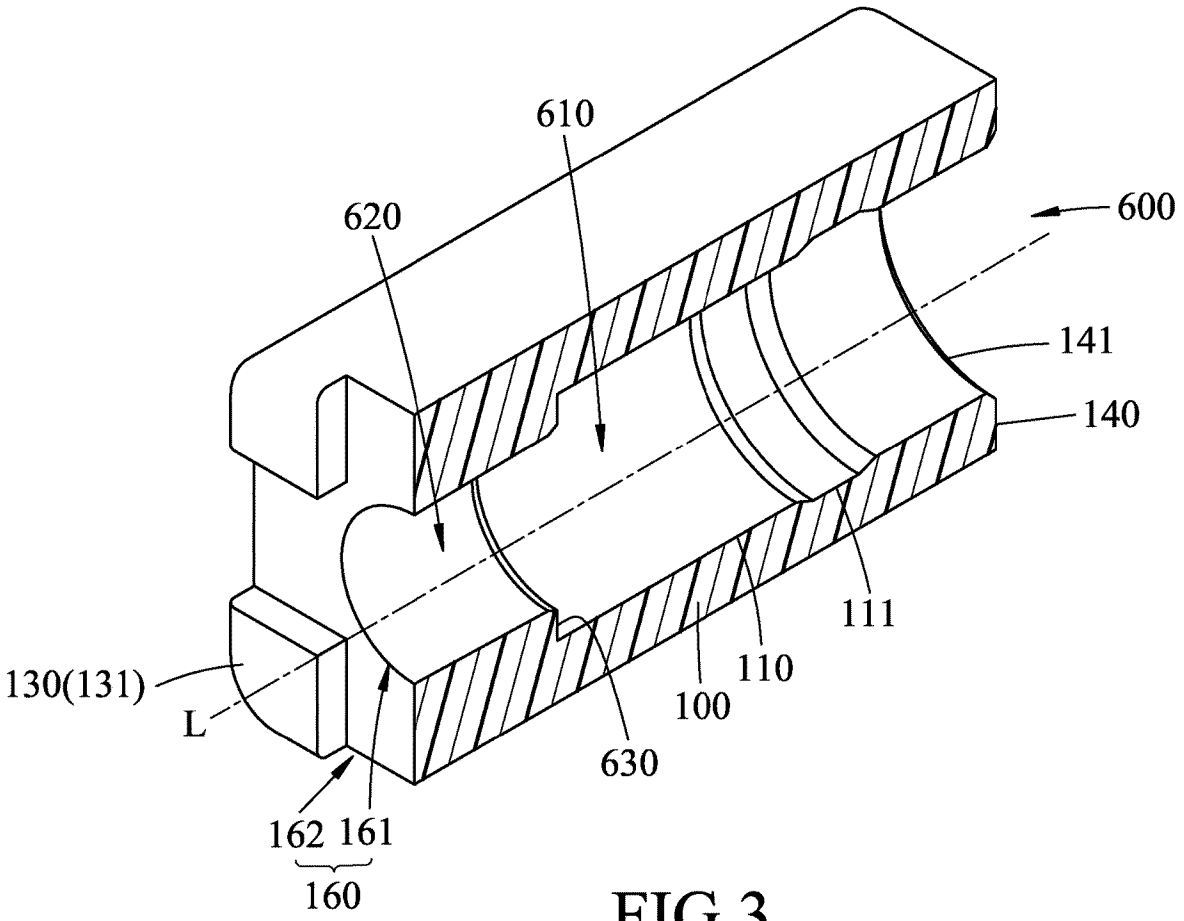
FIG. 3 is a sectional perspective view of an insulated housing of the first embodiment.
Figure 4:
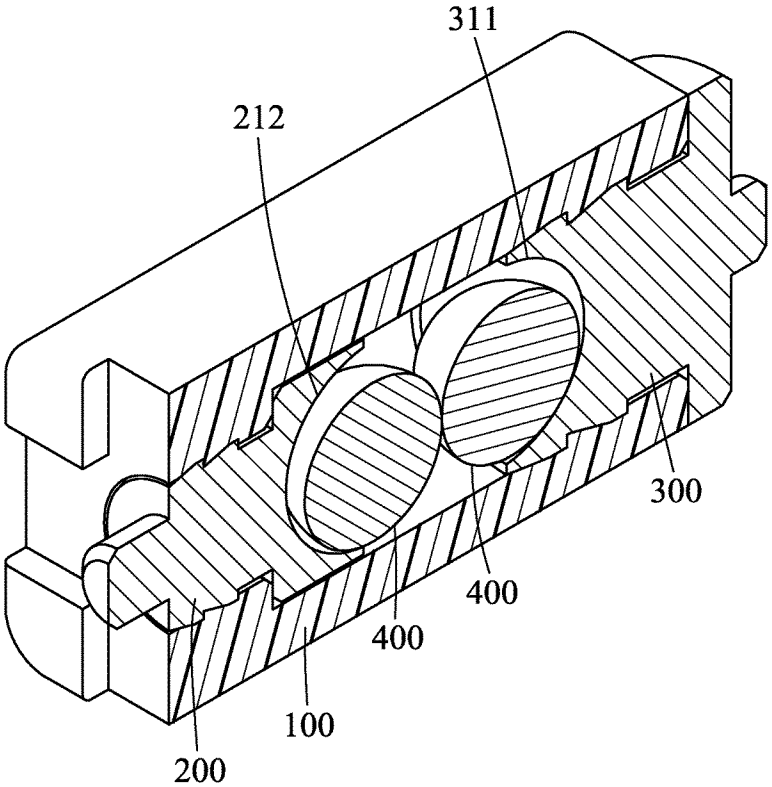
FIG. 4 is a first alternative form of the first embodiment.

Referring to FIGS. 1 to 3, a sensor switch according to the first embodiment of the present disclosure is shown to include an insulated housing 100, a first conductive terminal 200, a second conductive terminal 300 and a conductive member 400.

The insulated housing 100 defines an axis (L), and has first and second end faces 130, 140 opposite to each other along the axis (L), an inner wall surface 110 defining a through hole 600 that extends from the first end face 130 to the second end face 140, an outer wall surface 150 connected between outer peripheries of the first and second end faces 130, 140, a trapezoidal annular groove 111 indented inwardly from the inner wall surface 110, and a cutout 160 indented inwardly from the first end face 130. The through hole 600 includes a large diameter hole section 610 proximate to the second end face 140, a small diameter hole section 620 proximate to the first end face 130 and having a hole diameter smaller than that of the large diameter hole section 610, and a shoulder 630 interconnecting the large and small diameter hole sections 610, 620. The first end face 130 has an opening 131 communicating with the small diameter hole section 620. The second end face 140 has an opening 141 communicating with the large diameter hole section 610. The trapezoidal annular groove 111 is located in the large diameter hole section 610. The cutout 160 has a central portion 161 communicating with the opening 131 and the small diameter hole section 620, and a plurality of spaced-apart connecting portions 162 extending outwardly from the central portion 161 toward the outer wall surface 150.

It should be noted herein that the ratio of cross-sectional areas between the large and small diameter hole sections 610, 620 is between 1 and 3, which corresponds to the depth of the annular grooves 120 indented into the inner wall surface 110. The cross-sectional area of each of the large and small diameter hole sections 610, 620 is measured in a direction transverse to the axis (L). The smaller the ratio of the cross-sectional areas between the large and small diameter hole sections 610, 620, the poorer the anti-loosening effect. But, if the ratio is too large, a problem will occur with respect to the processing capability. Hence, the ratio of the cross-sectional areas between 1 and 3 is preferable. In this embodiment, the ratio of the cross-sectional areas is between 1.3 and 1.6, but is not limited thereto. An assembly direction (X) is defined in this embodiment as a direction extending from the second end face 140 toward the first end face 130.

The first conductive terminal 200 includes a head portion 210, and a stem portion 220 connected to the head portion 210. It should be noted herein that, since a width of the stem portion 220 measured in a direction transverse to the axis (L) is smaller than that of the head portion 210, and since the small diameter hole section 620 is located between the head portion 210 and the stem portion 220, to assemble the first conductive terminal 200 to the insulated housing 100, the stem portion 220 must first be inserted into the large diameter hole section 610 along the assembly direction (X) and then embedded in the small diameter hole section 620, so that the head portion 210 may be embedded in the large diameter hole section 610. The head portion 210 has an abutment surface 211 abutting against the shoulder 630, and a first contact surface 212 opposite to the abutment surface 211. The stem portion 220 includes a stem peripheral surface 221, a plurality of annular barbs 222 formed on the stem peripheral surface 221, a stem end face 223 connected to the stem peripheral surface 221, and a first electrical contact 224 protruding from the stem end face 223.

It is worth to mention herein that the first electrical contact 224 extends out of the small diameter hole section 620, the central portion 161 of the cutout 160 and the opening 131 in the first end face 130 to connect with a circuit node (not shown). Further, when the stem portion 220 is embedded in the small diameter hole section 620, a portion of the inner wall surface 110 that defines the small diameter hole portion 620 is deformed by the annular barbs 222 of the stem portion 220 to form annular grooves 120, the number of which corresponds to that of the annular barbs 222. Moreover, each barb 222 has a barb stop surface 225 so that, when the stem portion 220 is embedded in the small diameter hole section 620, the barb stop surfaces 225 of the barbs 222 can respectively engaged with the annular grooves 120 to prevent the first conductive terminal 200 from moving in a direction opposite to the assembly direction (X).

The second conductive terminal 300 includes a plug portion 310, and an end cap 320 connected to the plug portion 310. It should be noted herein that, in this embodiment, a width of the plug portion 310 measured in the direction transverse to the axis (L) is smaller than that of the end cap 320, and a width of the large diameter hole section 610 measured in the direction transverse to the axis (L) is also smaller than that of the end cap 320, so that when the second conductive terminal 300 is assembled to the insulated housing 100, the plug portion 310 must first be inserted into the large diameter hole section 610 along the assembly direction (X) via the opening 141 and embedded therein. The plug portion 310 embedded in the large diameter hole section 610 is spaced apart from the head portion 210 of the first conductive terminal 200, and has a second contact surface 311 facing the first contact surface 212, a plug peripheral surface 312 connected to the second contact surface 311, and a plurality of annular barbs 313 formed on the plug peripheral surface 312. The end cap 320 has a cap stop surface 321 abutting against the second end face 140, a cap end face 322 opposite to the cap stop surface 321, a cap peripheral surface 324 interconnecting the cap stop surface 321 and the cap end face 322, and a second electrical contact 323 protruding from the cap end face 322.

It is worth to mention herein that, when the plug portion 310 is embedded in the large diameter hole section 610, another portion of the inner wall surface 110 that defines the large diameter hole portion 610 is deformed by the annular barbs 313 of the plug portion 310 to form annular grooves 121, the number of which corresponds to that of the annular barbs 313. Specifically, the trapezoidal annular groove 111 is changed into the annular grooves 121 by the annular barbs 313 when the plug portion 310 is embedded in the large diameter hole section 610. Further, each annular barb 313 has a barb stop surface 314 so that, when the plug portion 310 is embedded in the large diameter hole section 610, the barb stop surfaces 314 of the barbs 313 can respectively engage with the annular grooves 121 to prevent the second conductive terminal 300 from moving in a direction opposite to the assembly direction (X). Moreover, the cap peripheral surface 324 has a plurality of contact edges 325 flush with the outer wall surface 150. In this embodiment, the insulated housing 100 has a rectangular cross section, the end cap 320 has a cylindrical shape, and both are symmetrical relative to the axis (L). As such, the number of the contact edges 325 is at least two, that is, top and bottom contact edges 325, and the second electrical contact 323 or the bottom contact edge 325 that is flush with a bottom side of the outer wall surface 150 can be used to connect with another circuit node (not shown).

Figure 5:
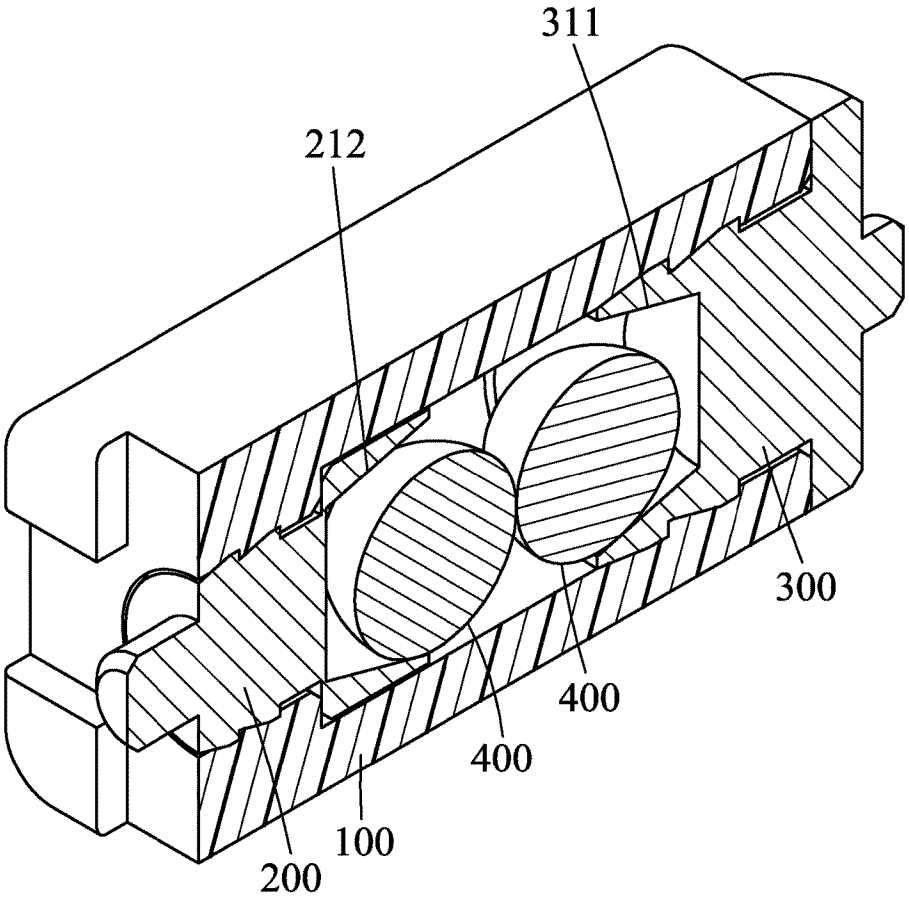
FIG. 5 is a second alternative form of the first embodiment.
Figure 6:
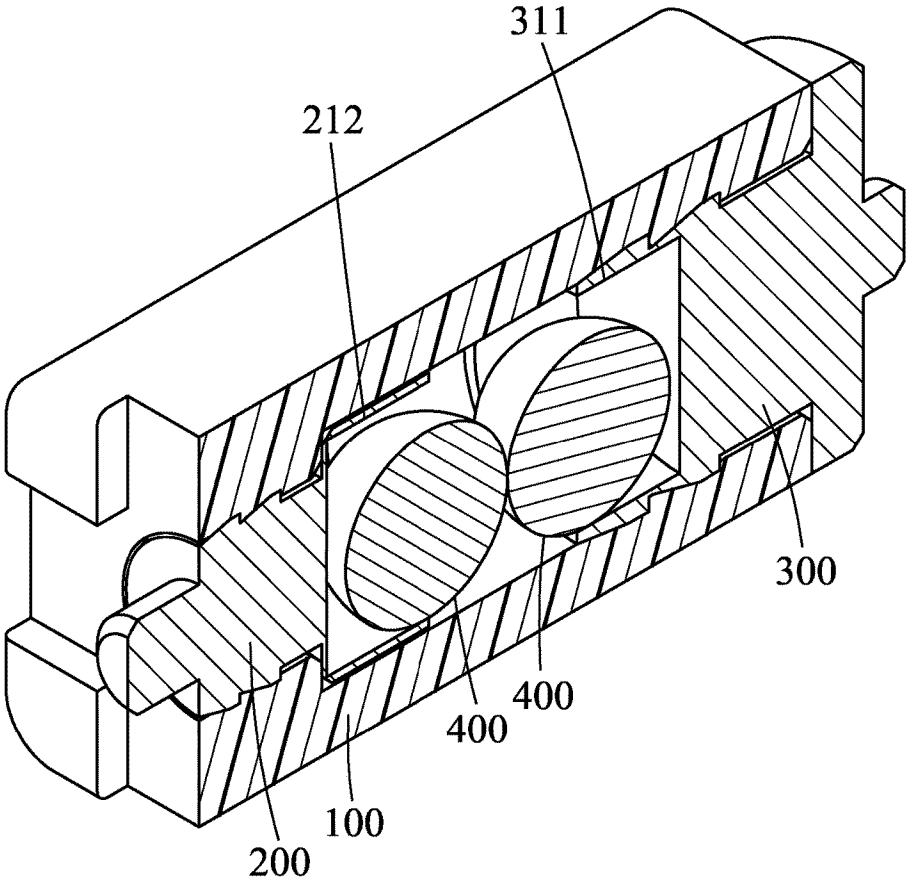
FIG. 6 is a third alternative form of the first embodiment.
Figure 7:
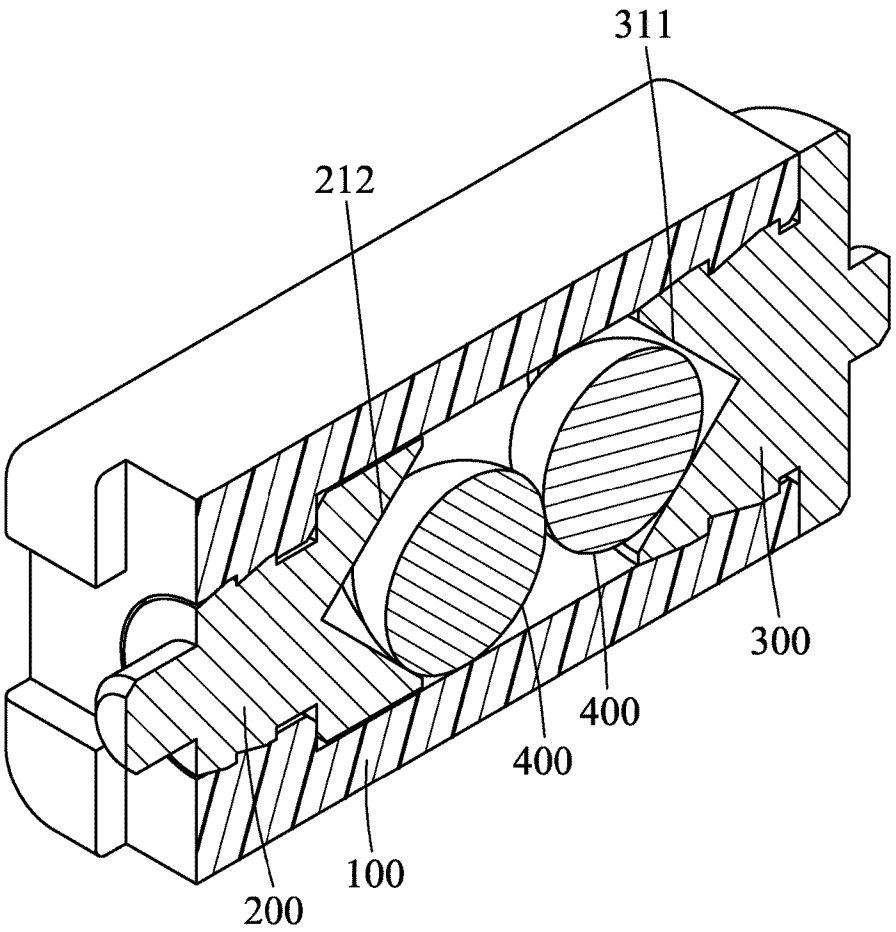
FIG. 7 is a fourth alternative form of the first embodiment.
Figure 8:
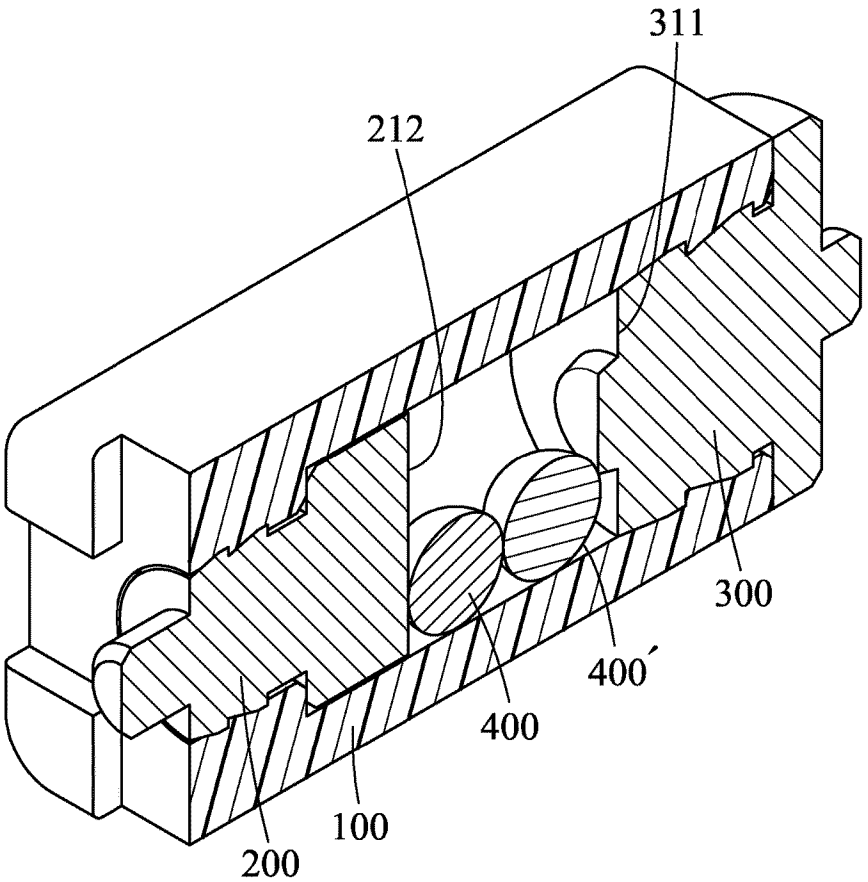
FIG. 8 is a fifth alternative form of the first embodiment.
Figure 9:
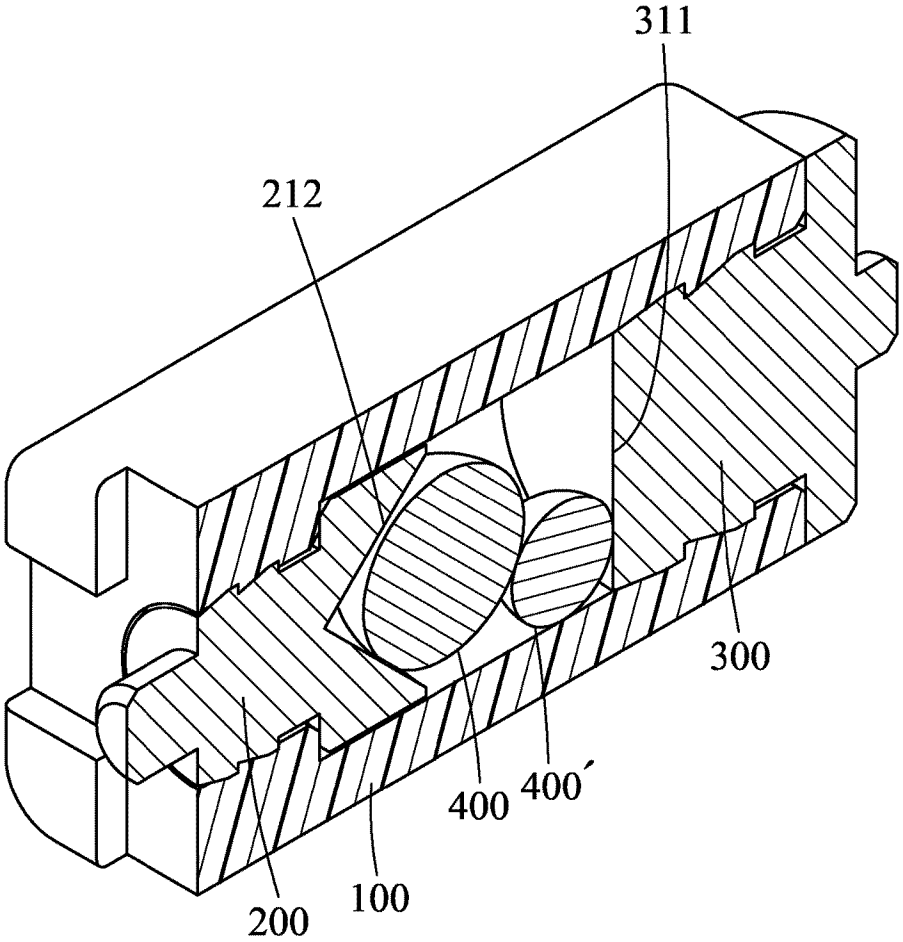
FIG. 9 is a sixth alternative form of the first embodiment.
Figure 10:
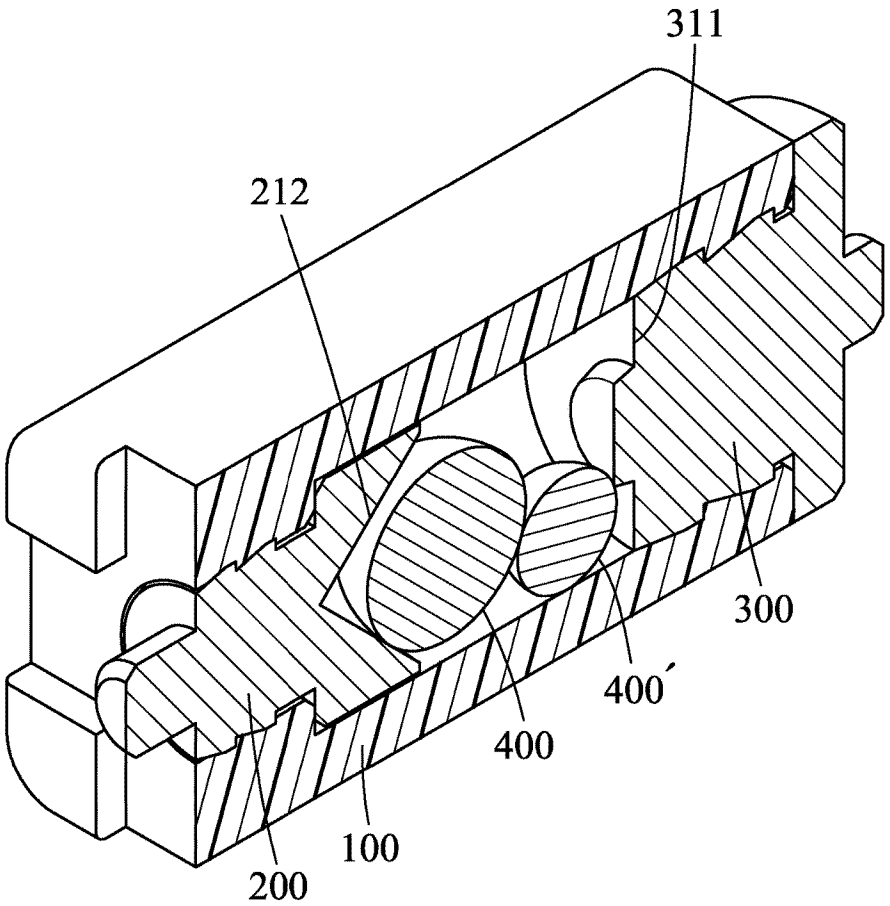
FIG. 10 is a seventh alternative form of the first embodiment.
Figure 11:
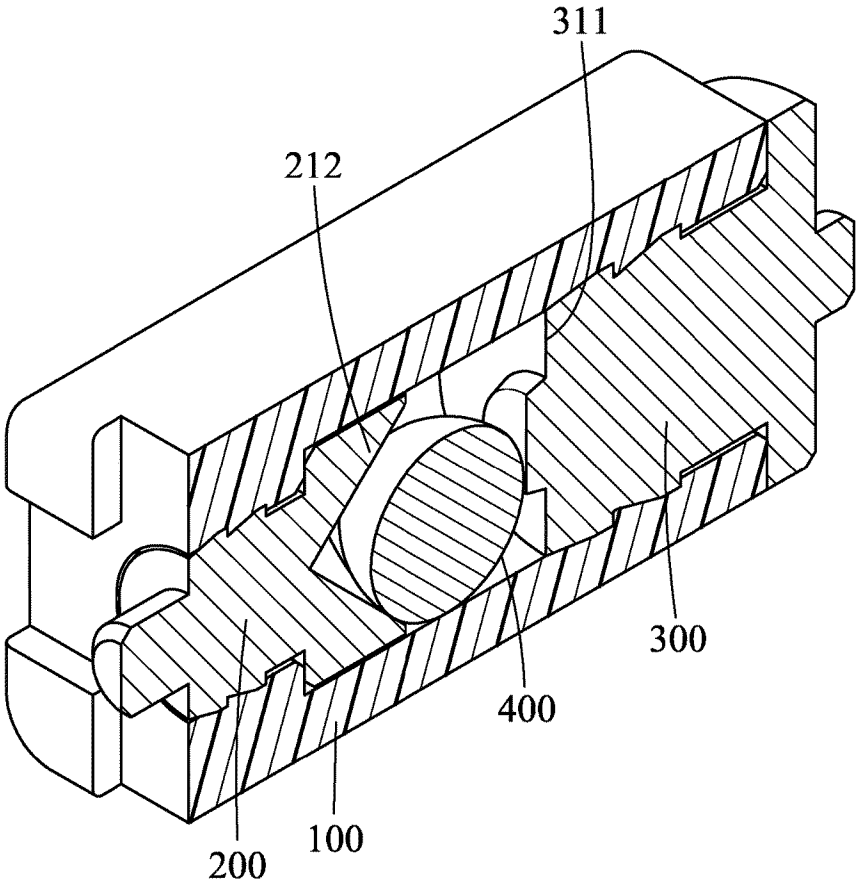
FIG. 11 is an eighth alternative form of the first embodiment.

After the first conductive terminal 200 is assembled to the insulated housing 100, the conductive member 400 is then placed in the large diameter hole section 610 along the assembly direction (X), after which the second conductive terminal 300 is assembled to the insulated housing 100. The inner wall surface 110 and the first and second contact surfaces 212, 311 cooperatively confine a sensing chamber 700. The conductive member 400 is accommodated in the sensing chamber 700, and is rollable therein between a closed circuit position and an open circuit position. It should be noted herein that, in this embodiment, the grooves defined by the first and second contact surfaces 212, 311 are both arcuate, but are not limited thereto. For example, the shapes of the grooves defined by the first and second contact surfaces 212, 311 may be trapezoidal, U-shape and V-shape, as shown in FIGS. 5 to 7, respectively. Furthermore, the first and second contact surfaces 212, 311 may be planar, as shown in FIGS. 8 and 9, respectively, and the second contact surface 311 may have a protrusion, as shown in FIGS. 8, 10 and 11. Moreover, the number of the conductive member 400 in this embodiment is one, but is not limited thereto. For instance, as shown in FIGS. 4 to 10, two conductive members 400 may be provided in the insulated housing 100, and as shown in FIGS. 9 and 10, the sizes of the conductive members 400, 400' may be different. The number and size of the conductive member 400 of the sensor switch are related to the sensitivity with respect to triggering the open circuit, so that different use requirements of the sensor switch must be considered in configuring a suitable conductive member 400.

As shown in FIG. 2, when the conductive member 400 is in the closed circuit position, the conductive member 400 and the first and second contact surfaces 212, 311 are in contact with each other to form a current path, so that the circuit nodes can transmit signals through the current path. On the other hand, when the conductive member 400 is in the open circuit position, at least two of the conductive member 400 and the first and second contact surfaces 212, 311 are not in contact with each other, so that no current path is formed. Hence, the circuit nodes cannot transmit signals.

Through the aforesaid description, a method of assembly of the sensor switch of the present disclosure can be summarized. With reference to FIGS. 1 to 3, the method of assembly of the sensor switch of this disclosure includes the following steps:

(A) inserting the first conductive terminal 200 into the large diameter hole section 610 along the assembly direction (X) with the stem portion 220 thereof being inserted first into the large diameter hole section 610;

(B) pushing the first conductive terminal 200 into the through hole 600 until the abutment surface 211 thereof abuts against the shoulder 630, during this time, the stem portion 220 is embedded in the small diameter hole section 620, and a portion of the inner wall surface 110 of the insulated housing 100 that defines the small diameter hole portion 620 is deformed by the annular barbs 222 of the stem portion 220 to form the annular grooves 120, the annular barbs 222 and the annular grooves 120 being engaged to each other to increase frictional resistance between the first conductive terminal 200 and the insulated housing 100, the direction of the annular barbs 222 being opposite to the assembly direction (X) so as to prevent the first conductive terminal 200 from loosening from the insulated housing 100;

(C) inserting the conductive member 400 into the large diameter hole section 610 along the assembly direction (X); and (D) inserting the plug portion 310 of the second conductive terminal 300 into the large diameter hole section 610 along the assembly direction (X), and pushing the cap end face 322 until the cap stop surface 321 abuts against the second end face 140 of the insulated housing 100, during this time, another portion of the inner wall surface 110 of the insulated housing 100 that defines the large diameter hole portion 610 is deformed by the annular barbs 313 of the plug portion 310 to form the annular grooves 121, the annular barbs 313 and the annular grooves 121 being engaged to each other to increase frictional resistance between the second conductive terminal 300 and the insulated housing 100, the direction of the annular barbs 313 being opposite to the assembly direction (X) so as to prevent the second conductive terminal 300 from loosening from the insulated housing 100, wherein the inner wall surface 110 and the first and second contact surfaces 212, 311 cooperatively define the sensing chamber 700, and the conductive member 400 is roll ably accommodated in the sensing chamber 700.

It should be noted herein that, in the aforesaid flow of steps, the description of any process or manner should be viewed as a module, a fragment, a part or a step of the workflow that contains one or more specific functions which can be implemented in the process. If the same function or effect can be achieved using the method known to those skilled in the art by changing the sequence of the steps, then it should be included in the scope of the present disclosure.

Figure 12:
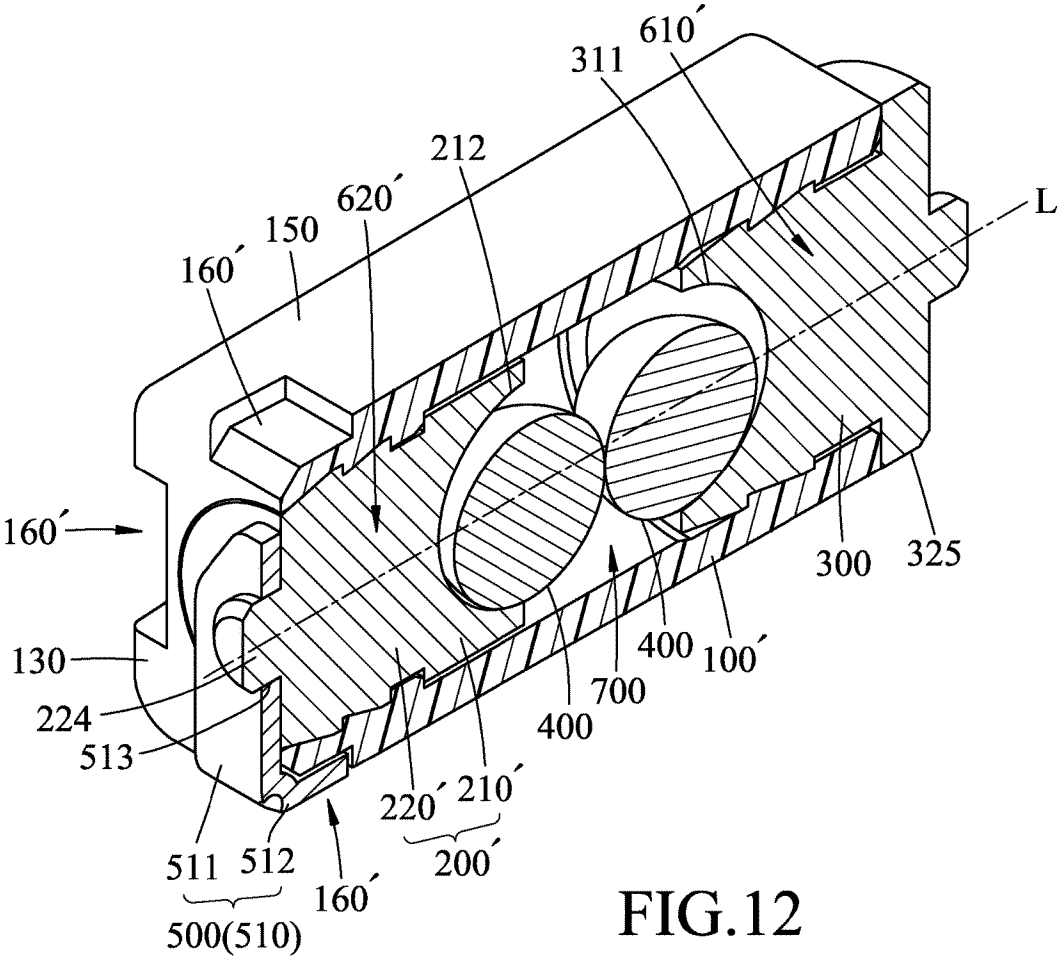
FIG. 12 is a sectional perspective view of a sensor switch according to the second embodiment of the present disclosure.

Referring to FIG. 12, the second embodiment of the sensor switch according to this disclosure is shown to be similar to the first embodiment. Particularly, the sensor switch of this embodiment includes an insulated housing 100', a first conductive terminal 200', and a second conductive terminal 300. The second embodiment differs from the first embodiment in that:

(1) The sensor switch includes two conductive members 400 disposed in the sensing chamber 700, and further includes a pin assembly 500.

(2) The ratio of the cross-sectional areas between the large and small diameter hole sections 610', 620' of the insulated housing 100' measured in the direction transverse to the axis (L) is between 1 and 1.5.

(3) A plurality of cutouts 160' are formed in the outer wall surface 150 and extend through the first end face 130 of the insulated housing 100'.

(4) The pin assembly 500 includes a pin member 510 having an L-shape. The pin member 510 includes an upright portion 511, and a horizontal portion 512 connected transversely to the upright portion 511. It should be noted herein that, in this embodiment, the upright portion 511 is formed with an engaging hole 513, and the first electrical contact 224 is disposed on and engaged with the engaging hole 513, so that the pin member 510 can be electrically connected to the first conductive terminal 200'. Furthermore, the horizontal portion 512 is received in a corresponding one of the cutouts 160' with a bottom side thereof slightly protruding out of the bottom side of the outer wall surface 150 so as to be able to connect with one of the circuit nodes.

Figure 13:
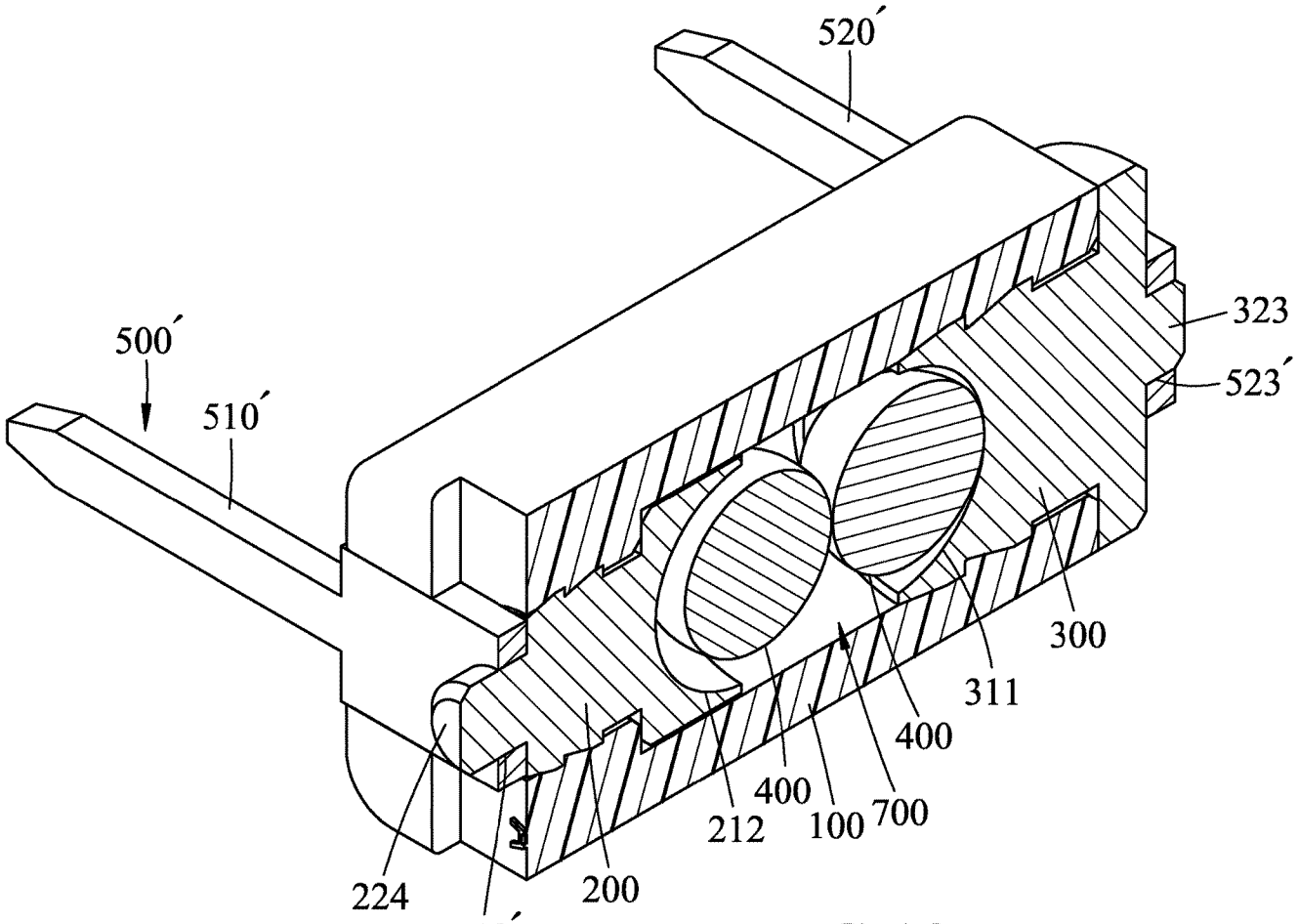
FIG. 13 is a sectional perspective view of a sensor switch according to the third embodiment of the present disclosure.

Referring to FIG. 13, the third embodiment of the sensor switch according to this disclosure is shown to be similar to the first embodiment. Particularly, the sensor switch of this embodiment includes an insulated housing 100 and first and second conductive terminals 200, 300. However, in this embodiment, the sensor switch includes two conductive members 400 disposed in the sensing chamber 700, and further includes a pin assembly 500'. The pin assembly 500' includes a first pin member 510' electrically connected to the first conductive terminal 200, and a second pin member 520' electrically connected to the second conductive terminal 300. The first and second pin members 510', 520' are through-hole pins, and respectively have engaging holes 513', 523' for receiving the first and second electrical contacts 224, 323, respectively. Each of the first and second pin members 510', 520' can be inserted into a through hole of a circuit board (not shown) or in a socket (not shown) of a dual in-line package (DIP).

Figure 14:
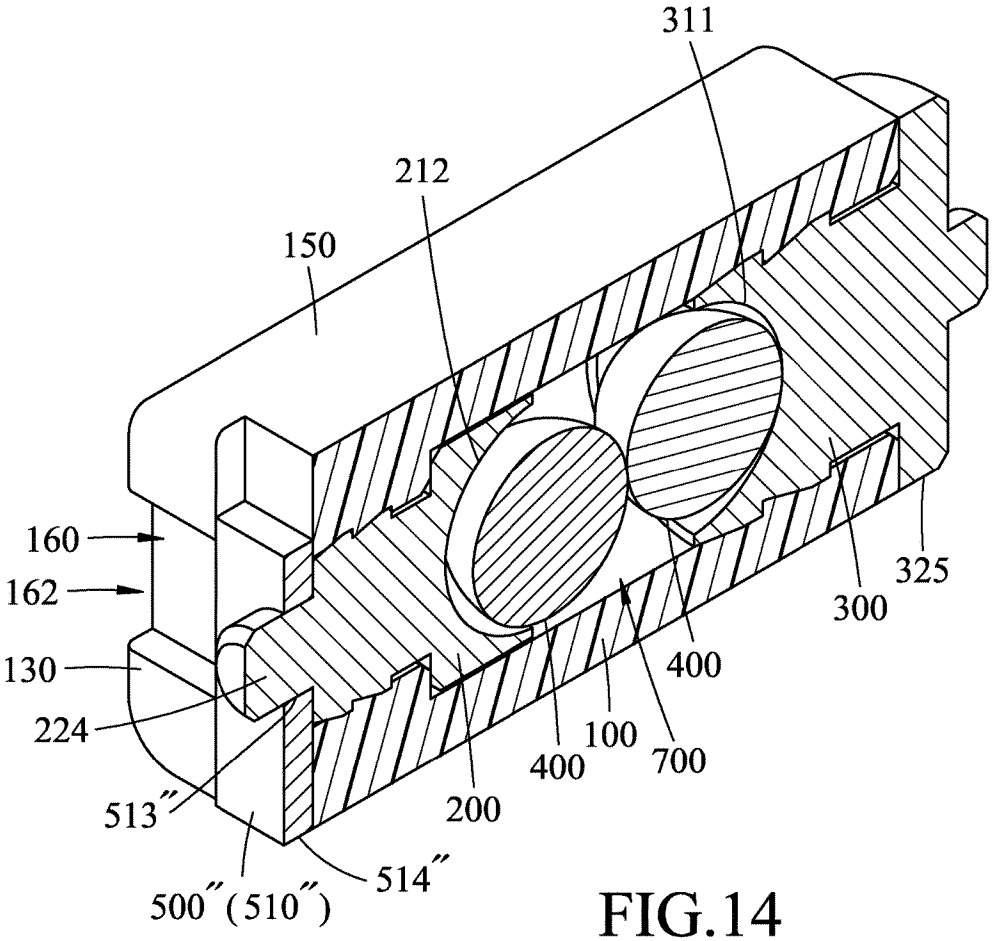
FIG. 14 is a sectional perspective view of a sensor switch according to the fourth embodiment of the present disclosure.

Referring to FIG. 14, the fourth embodiment of the sensor switch according to this disclosure is shown to be similar to the first embodiment. Particularly, the sensor switch of this embodiment includes an insulated housing 100 and first and second conductive terminals 200, 300. However, in this embodiment, the sensor switch includes two conductive members 400 disposed in the sensing chamber 700, and further includes a pin assembly 500". The pin assembly 500" includes a rectangular pin member 510" disposed on the central portion 161 (see FIG. 1) and one of the connecting portions 162 of the cutout 160. The pin member 510" has an engaging hole 513", and a connecting surface 514" substantially flush with a bottom side of the outer wall surface 150. The first electrical contact 224 is received in the engaging hole 513" so as to electrically connect the pin member 510" and the first conductive terminal 200. Because the pin member 510" is disposed in the cutout 160 of the insulated housing 100, the connecting surface 514" and the contact edge 325 can be connected to the circuit nodes, respectively.

It should be noted herein that the pairing relationship between the first and second contact surfaces 212, 311 shown in FIGS. 1 to 14 is not limited to what is disclosed in each figure, as long as they can match each other, it is included in the scope of this disclosure. For instance, the first contact surface 212 having a trapezoidal shape may match with the second contact surface 311 having an arcuate shape.

In sum, the sensor switch of this disclosure has the following effects and advantages so that it can achieve the object thereof:

(1) Through the barb stop surfaces 225, 314 of the annular barbs 222, 313 engaging with the respective annular grooves 120, 121 of the insulated housing 100, the frictional resistance between the first or second conductive terminal 200, 300 and the insulated housing 100 can be increased, so that the first or second conductive terminal 200, 300 can be prevented from moving in a direction opposite to the assembly direction (X), thereby achieving a stable connection effect.

(2) The first conductive terminal 200 is inserted into the large diameter hole section 610 along the assembly direction (X) until the abutment surface 211 thereof abuts against the shoulder 630 to increase the engaging area, so that, when the second conductive terminal 300 is assembled to the insulated housing 100, the first conductive terminal 200 is prevented from moving further along the assembly direction (X) due to air pressure generated thereby. Hence, the anti-loosening effect can be achieved.

(3) Through the configuration of the annular barbs 222 and the annular barbs 313 embedded in the inner wall surface 110 of the insulated housing 100 to form the annular grooves 120 and the annular grooves 121, respectively, the ratio of the cross-sectional areas between the large and small diameter hole sections 610, 620 can be slightly adjusted to correspond to the depths of the annular grooves 120, 121, so that different use demands can be met. For instance, under an environment where there is a severe temperature change, the depths of the annular grooves 120, 121 should be deeper, that is, the thickness of the annular barbs 222 and 313 should be increased, so that the ratio of the cross-sectional areas between the large and small diameter hole sections 610, 620 can be increased, thereby preventing the first and second conductive terminals 200, 300 from loosening from the insulated housing 100 due to thermal expansion and contraction.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A sensor switch comprising:

an insulated housing defining an axis and having an inner wall surface that defines a through hole extending from one end to the other end of said inner wall surface along the axis, said through hole including a first diameter hole section proximate to said one end of said inner wall surface, a second diameter hole section proximate to said other end of said inner wall surface and having a hole diameter smaller than that of said first diameter hole section, and a shoulder interconnecting said first and second diameter hole sections, the ratio of cross-sectional areas between said first and second diameter hole sections being larger than one but smaller than three;

a first conductive terminal inserted into said through hole and including a head portion embedded in said first diameter hole section, and a stem portion embedded in said second diameter hole section, said head portion having an abutment surface abutting against said shoulder, and a first contact surface opposite to said abutment surface, said stem portion having a width measured in a direction transverse to the axis smaller than that of said head portion and having a section extending out of said second diameter hole section;

a second conductive terminal inserted into said through hole and including a plug portion that is embedded in said first diameter hole section spaced apart from said head portion of said first conductive terminal and that has a second contact surface facing said first contact surface;

said inner wall surface of said insulated housing and said first and second contact surfaces cooperatively confining a sensing chamber; and at least one conductive member accommodated in said sensing chamber and rollable between a closed circuit position, in which said at least one conductive member and said first and second contact surfaces cooperatively form a current path, and an open circuit position, in which said at least one conductive member and said first and second contact surfaces does not form a current path.

2. The sensor switch as claimed in claim 1, wherein said plug portion of said second conductive terminal further has a plug peripheral surface connected to said second contact surface, and at least one annular barb formed on said plug peripheral surface and having a barb stop surface, said insulated housing further having at least one annular groove indented inwardly from said inner wall surface and matching with said at least one annular barb, said barb stop surface being engaged to said at least one annular groove to stop said second conductive terminal from moving in a direction opposite to an insertion direction thereof into said through hole.

3. The sensor switch as claimed in claim 1, wherein said stem portion of said first conductive terminal has a stem peripheral surface extending along the axis, and at least one annular barb formed on said stem peripheral surface and having a barb stop surface, said insulated housing further having at least one annular groove indented inwardly from said inner wall surface and matching with said at least one annular barb of said stem portion, said barb stop surface of said at least one annular barb of said stem portion being engaged to said at least one annular groove to stop said first conductive terminal from moving in a direction opposite to an insertion direction thereof into said through hole.

4. The sensor switch as claimed in claim 3, wherein said insulated housing further has a first end face at said other end thereof, a second end face at said one end thereof and opposite to said first end face, and an outer wall surface interconnecting said first and second end faces, said first end face having an opening communicating with said second diameter hole section, said second end face having an opening communicating with said first diameter hole section, said second conductive terminal further including an end cap connected to said plug portion, said end cap having a cap stop surface abutting against said second end face of said insulated housing, and a cap end face opposite to said cap stop surface.

5. The sensor switch as claimed in claim 4, wherein said stem portion further has a stem end face connected to said stem peripheral surface, and a first electrical contact projecting outwardly from said stem end face, said first electrical contact being said section of said stem portion that extends out of said second diameter hole section, said end cap further having a second electrical contact projecting outwardly from said cap end face.

6. The sensor switch as claimed in claim 5, wherein said insulated housing further has a cutout extending inwardly from said first end face of said insulated housing, said cutout having a central portion communicating with said second diameter hole section, and at least one connecting portion extending from said central portion to said outer wall surface of said insulated housing, said first electrical contact further extending through said central portion of said cutout.

7. The sensor switch as claimed in claim 4, wherein said end cap further has a cap peripheral surface interconnecting said cap stop surface and said cap end face, said cap peripheral surface having at least one contact edge substantially flush with said outer wall surface of said insulated housing.

8. The sensor switch as claimed in claim 4, further comprising a pin assembly which includes a pin member electrically connected to said first conductive terminal, said insulated housing further having at least one cutout formed in said outer wall surface and extending through said first end face, said pin member having an L-shape and including an upright portion, and a horizontal portion connected transversely to said upright portion and received in said at least one cutout.

9. The sensor switch as claimed in claim 6, further comprising a pin assembly which includes a first pin member electrically connected to said first conductive terminal, and a second pin member electrically connected to said second conductive terminal, said first and second pin members being through-hole pins.

10. The sensor switch as claimed in claim 6, further comprising a pin assembly which includes a pin member electrically connected to said first conductive terminal, said pin member being received in said central portion and said at least one connecting portion of said cutout, said pin member having a connecting surface substantially flush with said outer wall surface of said insulated housing.

11. The sensor switch as claimed in claim 1, wherein said first contact surface defines one of a planar surface and a groove.

12. The sensor switch as claimed in claim 11, wherein said groove is one of an arcuate shape, a V-shape and a U-shape.

13. The sensor switch as claimed in claim 1, wherein said second contact surface defines one of a planar surface, a groove and a protrusion.

14. The sensor switch as claimed in claim 13, wherein said groove of said second contact surface is one of an arcuate shape, a V-shape and a U-shape.

15. A method of assembly of a sensor switch which includes an insulated housing, a first conductive terminal, a second conductive terminal, and at least one conductive member, the insulated housing defining an axis and having first and second end faces opposite to each other along the axis, and an inner wall surface defining a through hole that extends from the first end face to the second end face, the through hole including a first diameter hole section proximate to the second end face, a second diameter hole section proximate to the first end face and having a hole diameter smaller than that of the first diameter hole section, and a shoulder interconnecting the first and second diameter hole sections, the first conductive terminal including a head portion, and a stem portion having a width measured in a direction transverse to the axis smaller than that of the head portion, the head portion having an abutment surface, and a first contact surface opposite to the abutment surface, the stem portion having a stem peripheral surface, and at least one annular barb formed on the stem peripheral surface, the second conductive terminal including a plug portion, and an end cap connected to the plug portion, the plug portion having a second contact surface, a plug peripheral surface connected to the second contact surface, and at least one annular barb formed on the plug peripheral surface, the end cap having a cap stop surface and a cap end face opposite to the cap stop surface, an assembly direction being defined as a direction parallel to the axis and extending from the second end face toward the first end face, said method of assembly comprising:

(A) inserting the first conductive terminal into the first diameter hole section along the assembly direction with the stem portion thereof being inserted first into the first diameter hole section;

(B) pushing the first conductive terminal into the through hole until the abutment surface thereof abuts against the shoulder, during this time, the stem portion is embedded in the second diameter hole section, and a portion of the inner wall surface of the insulated housing that defines the second diameter hole section is deformed by the at least one annular barb of the stem portion to form at least one annular groove, the at least one annular barb of the stem portion and the at least one annular groove being engaged to each other, the direction of the at least one annular barb of the stem portion being opposite to the assembly direction so as to prevent the first conductive terminal from loosening from the insulated housing;

(C) inserting the conductive member into the first diameter hole section along the assembly direction; and (D) inserting the plug portion of the second conductive terminal into the first diameter hole section along the assembly direction, and pushing the cap end face until the cap stop surface abuts against the second end face of the insulated housing, during this time, another portion of the inner wall surface of the insulated housing that defines the first diameter hole section is deformed by the at least one annular barb of the plug portion to form at least another one annular groove, the at least one annular barb of the plug portion and the at least another one annular groove being engaged to each other, the direction of the at least one annular barb of the plug portion being opposite to the assembly direction so as to prevent the second conductive terminal from loosening from the insulated housing, wherein the inner wall surface and the first and second contact surfaces cooperatively define a sensing chamber, and the at least one conductive member is rollably accommodated in the sensing chamber.

* * * * *